US005657933A

United States Patent [19]

Williams

[11] Patent Number: 5,657,933

[45] Date of Patent: Aug. 19, 1997

[54] ADJUSTABLE FEED PLATE FOR PAPER SHREDDER

[76] Inventor: Robert M. Williams, 16 La Hacienda, Ladue, Mo. 63124

[21] Appl. No.: 515,646

[22] Filed: Aug. 16, 1995

[51] Int. Cl.[6] ..... B02C 13/286

[52] U.S. Cl. ..... 241/186.3; 241/189.1

[58] Field of Search ..... 241/186.3, 189.1, 241/189.2, 285.2

[56] References Cited

U.S. PATENT DOCUMENTS

| | | | |
|---|---|---|---|
| 1,975,406 | 10/1934 | Reschke | 241/186.3 X |
| 2,287,799 | 6/1942 | Hartshorn . | |
| 2,609,153 | 9/1952 | Moore | 241/186.3 |
| 2,767,929 | 10/1956 | West . | |
| 2,785,865 | 3/1957 | Berling . | |
| 2,954,176 | 9/1960 | Cole | 241/186.3 |
| 3,430,873 | 3/1969 | Wahl et al. . | |
| 3,610,543 | 10/1971 | Jensen . | |
| 3,813,045 | 5/1974 | Greiffenstern . | |
| 4,009,836 | 3/1977 | Strom et al. . | |
| 5,018,674 | 5/1991 | Williams . | |
| 5,381,971 | 1/1995 | Rehmer . | |

*Primary Examiner*—Mark Rosenbaum

*Attorney, Agent, or Firm*—Polster, Lieder, Woodruff & Lucchesi, L.C.

[57] ABSTRACT

A rotary shredder apparatus for reducing paper material having weight characteristic that creates difficulties in feeding the material for reduction, and in which the apparatus embodies an adjustable slide sheet having one position to allow bulky material to impact on reduction rotors by exposing a significant circumference of the rotary shredder, and another position reducing the exposed circumference of the shredding rotor so that light weight material can be drawn into the shredding rotor with the least amount of rotor fan effect generated on such material.

9 Claims, 2 Drawing Sheets

ADJUSTABLE FEED PLATE FOR PAPER SHREDDER

BACKGROUND OF THE INVENTION

1. Field of the Invention

The invention is directed to an apparatus for shredding paper having variations in weight, as well as flexibility and stiffness, all of which requires reduction by shredding for rendering the paper suitable for recycling or other reclaiming process.

2. Description of the Prior Art

In order to shred paper effectively in apparatus embodying rotary hammers, the papers needs to have a weight characteristic that will promote its capability of being drawn into the orbit of the rotating hammers where effective shredding reduction can be performed. Furthermore, the necessary rotation of the hammers must be at a speed to effect the ripping, tearing and impact reduction. Some paper to be shredded is responsive to the fan effect of the rotor and becomes difficult to shred properly due to being of such light weight that it has a blow back response and fails to enter into the shredding rotor.

BRIEF SUMMARY OF THE INVENTION

It is recognized that paper material requiring reduction by shredding presents a problem of obtaining consistent entry into a rotary shredder due to the response of light weight paper to the rotor fan effect.

The subject shredder apparatus has recognized the problems by being able to select the entry path for paper so that a suitable destruction is made between paper having a weight characteristic that does not easily respond to the fan effect of the shredding rotor as compared with light weight and fluffy types of paper that easily responds to the fan effect of the shredding rotor.

A principal object of the invention is directed to rotary shredding apparatus in which the direction of the approach of paper to the rotor can be altered to suit the characteristics of the paper requiring shredding reduction.

A further object is to provide rotary shredding apparatus with paper feed directing means that has the effect of conditioning the shredding rotor feed for drawing light weight paper into the shredding apparatus so that the feed hopper is not obstructed.

Other objects will be set forth in the description relating to the preferred embodiment of the invention.

BRIEF DESCRIPTION OF THE DRAWINGS

In the preferred embodiment of the apparatus, it is noted as follows.

DETAILED DESCRIPTION OF THE EMBODIMENT

Figure 1:
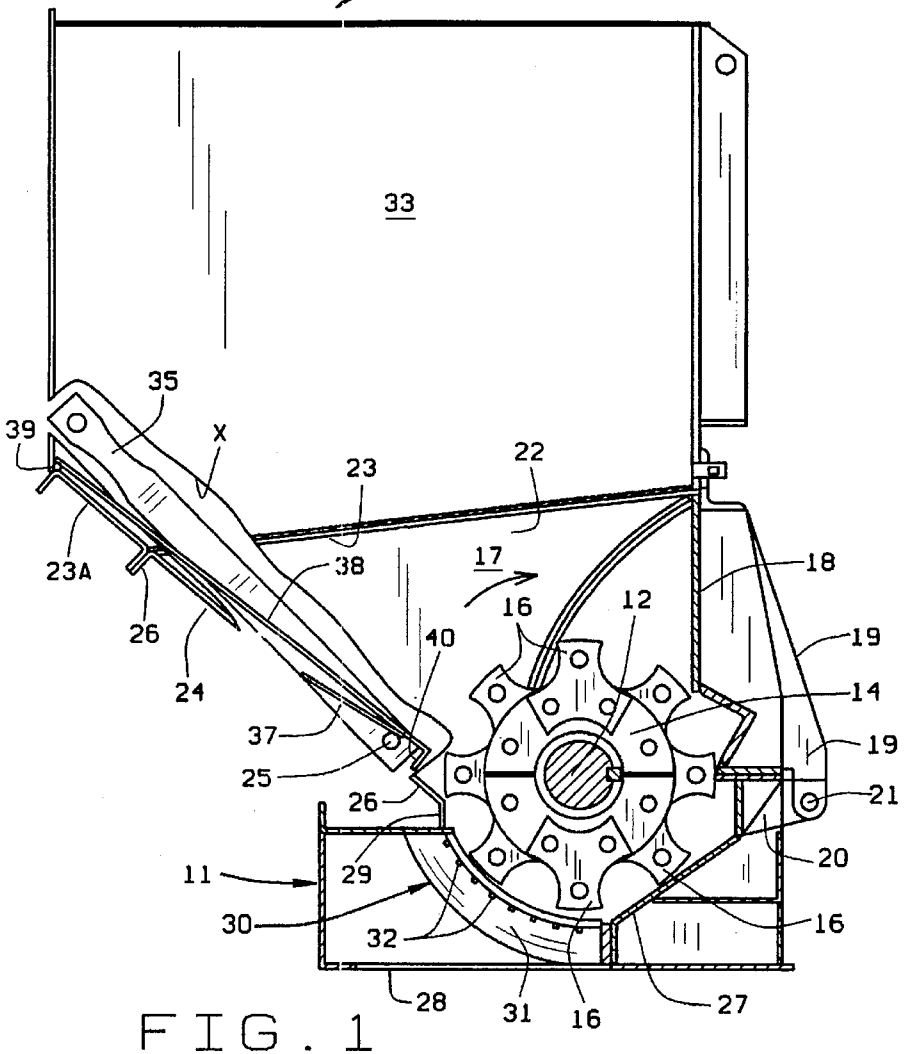
FIG. 1 is a schematic view of the apparatus with the operating means in position to receive bulk heavy paper.
Figure 4:
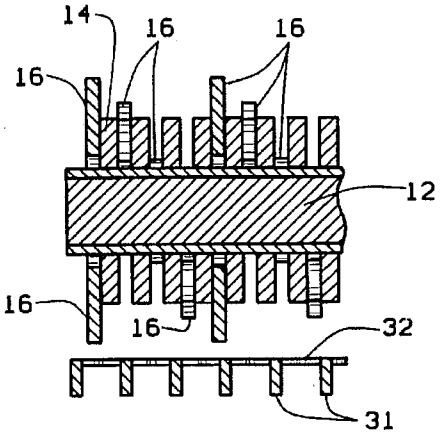
FIG. 4 is a fragmentary sectional view taken along line 4—4 in FIG. 3 of the shredding rotor.

The preferred embodiment of the paper shredder 10 is seen in FIG. 1 to include a base assembly 11 which carries a shaft 12 supported in suitable bearings (not shown). The shaft 12 is directed horizontally and is long enough to carry an assembly of discs 14 keyed to the shaft 12. The view of FIG. 4 shows a plurality of discs 14 keyed to the shaft 12. Each disc 14 carries two hammer elements 16 fixed in a non-pivoted position at 180° spacing. The respective discs 14 are angularly offset around the common shaft 12 whereby when seen as in FIG. 1, the respective pairs of hammer elements 16 on the respective discs behind the first disc 14 are stepped around the shaft circumference at approximately 45°. Thus, the first four discs 14 provide the appearance of four pairs of hammer elements 16. Additional sets of four discs behind the first four depicted in FIG. 1 repeat the angular displacement of the hammer elements 16 until the desired number of sets of four discs has been assembled on the common drive shaft 12.

The desired number of sets of four discs 14 are housed in an enclosing chamber 17 defined by a breaker wall 18 carried on a hinge support 19 pivoted at the bracket 20 on hinge pin 21. The chamber 17 is further defined by vertical side walls 22 having a slanted flange 23, and a slanted bottom wall 24 having at its lower end a shaft 25 which is parallel to the rotor shaft 12. The upper end of the slanted wall 24 ends in an out-turned flange 26. The structure of the chamber 17 is open between the lower end 26 of the wall 24 and the bracket 20 to receive the rotor shaft and the assembly of discs which carry the hammer elements 16. Furthermore, the base 11 carries a slanted wall 27 which lies adjacent the path of the hammer elements 16 to direct the material from the rotors into an outlet 28 in the base 11. In addition, the base 11 has a wall that positions a flange 29 to mate with the lower end of the wall 24 so that material processed by the hammer elements can be intercepted with very little of the shredded material being allowed to return to the entry of the material inlet side of the rotor. The shredded material thrown out by the rotor assembly passes through a grate 30 composed of curved ribs 31 secured in spaced positions by small shaped ribs 32 which present a minimum of resistance to the flow of shredded material.

Figure 2:
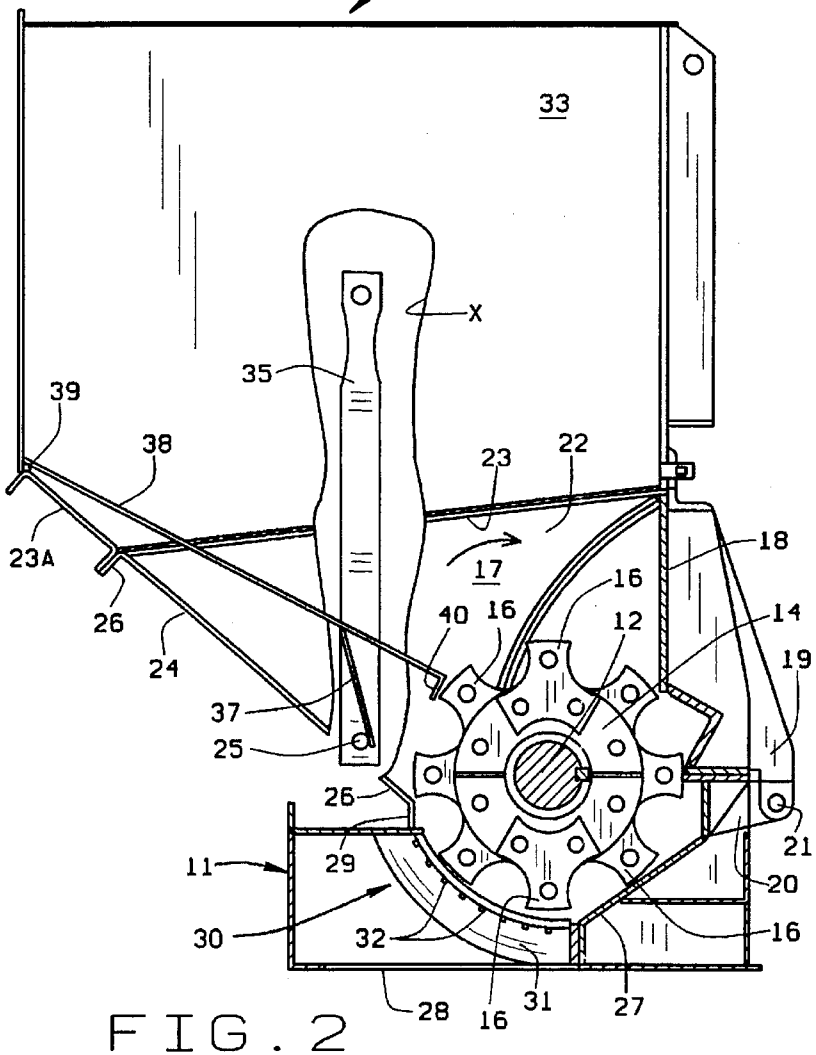
FIG. 2 is a schematic view of the apparatus of FIG. 1 with the paper feed means partly shifted to receive light weight paper.
Figure 3:
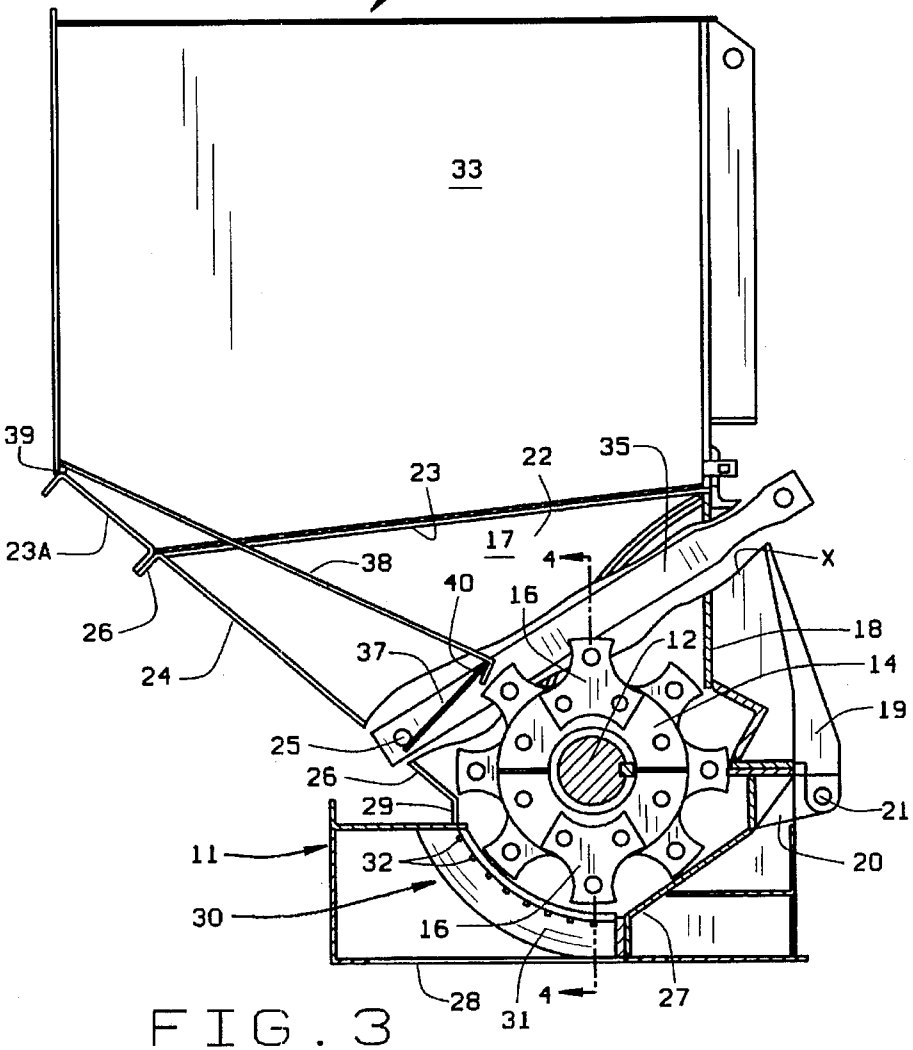
FIG. 3 is a schematic view of the apparatus adjusted to process light weight paper.

In the views of FIGS. 1, 2 and 3, the shredder rotor assembly of hammer elements 16 has a major portion of its circumference exposed to the chamber 17 where the most material to be shredded is received in the hopper 33. That hopper is seated on the slanted flange 23 of the chamber 17 with the end of an insert 23A fastened to the flange 26 of the slanted wall 24. The apparatus described in FIG. 1 is most suitable for shredding material that has a body consistence quite stable and not light weight and fluffy with a tendency to float if fluffed up. Thus, the apparatus as depicted in FIG. 1 is able to quickly shred and reduce paper material that has sufficient weight and body characteristics to settle down in the chamber 17 when the rotor assembly is operating. There may be a condition which finds that same incompletely shredded material can be carried back to the feed side of the rotor assembly of hammers 16 before returning to the discharge grate 30.

It is recognized that not all paper type material has a characteristic to settle down and pass through the shredding rotor assembly. Some materials are sufficiently fluffy and light weight to respond and float when agitated by the rotor. When material having the latter characteristic needs to be shredded, the apparatus can be adjusted to successfully handle such material by making a rapid adjustment in the apparatus, as illustrated in the change introduced in FIGS. 2 and 3 of the drawings.

FIG. 1 illustrates the apparatus in condition to shred more stable material by retaining an adjusting lever 35 in the external positions relative to the chamber 17. Since the lever 35 is on the outside, the wall of the hopper 33 and the side of the chamber 17 has been broken out to show the lever in full lines. The lower end of the lever is keyed to a transverse shaft 25 carried in the opposite vertical side walls 22 of chamber 17. One end of the shaft 25 must extend through a wall 22 so the lever 35 can be securely connected. Internally of chamber 17, the shaft 25 is connected to a sheet 37 which can rest upon the inner surface of the wall 24, in which the lever 35 is retained in the first adjusted position. The chamber 17 is provided with a material directing slide sheet 38 having a suitable width to fit between the oppositely spaced vertical walls 22 of the chamber. One of the walls 22 is not shown. The sheet 38 is secured at its upper end to a pivot rod 39 supported in the hopper side walls. The lower end of the sheet 38 is formed with a flange 40 which retains the sheet 38 in an operative position over the shaft 25 and resting on the sheet 37.

The thus described mechanism is provided to enable the apparatus to handle and shred light weight material by reducing the tendency of the rotor hammers 16 to agitate such material. The adjustment is made, as seen in FIGS. 2 and 3 in which structure is broken out at X to show the result of swinging the external lever 35 through the midpositions of FIG. 2, and end position in FIG. 3. In this location, the rotation of the shaft 25 external level 35 has swung the sheet 37 to an elevated position in which the slide sheet 38 has been elevated so the flange end is partly over the rotor assembly. The final position of lever 35 is reached, as in FIG. 3, when the lifting sheet 37 has raised the material slide sheet 38 enough to have the margin of sheet 37 engage the flange 40 to arrest further movement of the lever 35. By moving lever 35 to the position of FIG. 3, the slide sheet 38 has reduced the exposed circumference of the rotor assembly sufficiently to reduce the rotor hammers agitation of the light weight material sufficiently to suppress its tendency to be disturbed. The desired effect on the light weight material is to have the slide sheet 38 direct such material over the rotor assembly to allow the rotor hammers to draw such light weight material into the rotor assembly to be shredded.

When the apparatus has been adjusted to the position of FIG. 3, the lifting sheet 37 has been moved to a position engaged with flange 40 where it can effectively prevent any serious flow back to the inlet side of the rotor assembly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention and the scope of the claims are also desired to be protected.

What is claimed is:

1. A material shredding apparatus comprising:

a) housing structure having a base and a material receiving hopper having a slanted bottom wall and a breaker wall spaced from said slanted bottom wall;

b) a shaft mounted assembly of material shredding hammer elements operatively carried by said housing base between said slanted bottom wall and said breaker wall to expose said shaft mounted assembly of hammer elements to said material receiving hopper;

c) slide plate means in said housing structure having one end pivotally connected to said housing structure and an opposite end adjacent said assembly of shredding hammer elements, said slide plate having a first position lying adjacent said slanted bottom wall; and d) slide plate actuating means in position in said housing structure for lifting said slide plate into a position to limit the degree of exposure of said assembly of hammer elements to material in said housing structure.

2. The apparatus set forth in claim 1 wherein said slide plate actuating means is a lever positioned external to said housing structure and movable between positions external to said housing structure which determine the position of said slide plate in said housing structure.

3. The apparatus set forth in claim 1 wherein said slide plate actuating means is a plate pivoted in said housing structure and engaged under said slide plate to limit the movement of material into said assembly of hammer elements with said slide plate in said lifted position.

4. The apparatus set forth in claim 3 wherein said slide plate opposite end carries a stop element in position to be engaged with said slide plate actuating means to arrest its movement.

5. The apparatus set forth in claim 3 wherein said stop element on said slide plate is effective to limit said lever movement external to said housing structure.

6. The apparatus set forth in claim 1 wherein said slide plate in said lifted position directs material in said hopper to enter said limit degree of exposure of said hammer elements.

7. A material shredding apparatus comprising:

a) a housing structure having a material receiving hopper formed with a chamber providing a shredded material discharge;

b) a material shredding rotor operably carried in said chamber to direct shredded material into said discharge;

c) a wall in said chamber having a slanted position to direct material into said shredding rotor from above said discharge;

d) a pivot carried by said housing structure in position adjacent said shredding rotor with one end extending to the exterior of said housing structure;

e) a material directing slide surface overlying said slanted wall and having one end pivotally connected to said housing structure and an opposite end adjacent said pivot;

f) an operating element attached to said pivot at the interior of said housing structure, said operating element being engaged with said slide surface to pivot said slide surface relative to said wall having said slanted position for deflecting material directed into said shredding rotor; and g) a control lever connected to said pivot extended end at the exterior of said housing structure, said control lever operating said pivot to effect movement of said operating element to restrict material directed from said discharge reversely into said shredding rotor.

8. The material shredding apparatus set forth in claim 7 wherein said control lever position external to said housing structure visually indicates the operating element position for pivoting said slide surface to restrict material directed reversely into said shredding rotor.

9. The material shredding apparatus set forth in claim 8 wherein said control lever effecting movement of said operating element for reducing material circulation in said hopper by reducing the fan effect of said shredding rotor on material in said hopper.

* * * * *